US009592597B2

(12) United States Patent
Marks

(10) Patent No.: US 9,592,597 B2
(45) Date of Patent: Mar. 14, 2017

(54) FLAT CLINCH STAPLER ANVIL ASSEMBLY

(71) Applicant: WORKTOOLS, INC., Chatsworth, CA (US)

(72) Inventor: Joel S. Marks, Sherman Oaks, CA (US)

(73) Assignee: WORKTOOLS, INC., Chatsworth, CA (US)

( * ) Notice: Subject to any disclaimer, the term of this patent is extended or adjusted under 35 U.S.C. 154(b) by 549 days.

(21) Appl. No.: 14/159,264

(22) Filed: Jan. 20, 2014

(65) Prior Publication Data

US 2014/0203060 A1 Jul. 24, 2014

Related U.S. Application Data

(60) Provisional application No. 61/755,894, filed on Jan. 23, 2013.

(51) Int. Cl.

| | |
|---|---|
| ***B25C 5/02*** | (2006.01) |
| ***B27F 7/19*** | (2006.01) |
| *B25C 5/15* | (2006.01) |

(52) U.S. Cl.

CPC ..... *B25C 5/0207* (2013.01); *B25C 5/02* (2013.01); *B27F 7/19* (2013.01); *B25C 5/0264* (2013.01); *B25C 5/15* (2013.01)

(58) Field of Classification Search

CPC B25C 5/00; B25C 5/02; B25C 5/0207; B25C 5/0242; B25C 5/027; B25C 5/1617;

(Continued)

(56) References Cited

U.S. PATENT DOCUMENTS 389,661 A 9/1888 Mandel et al.
970,461 A 9/1910 Briggs et al.

(Continued)

FOREIGN PATENT DOCUMENTS

CN 1394721 A 2/2003
CN 1948022 A 4/2007

(Continued)

OTHER PUBLICATIONS

PCT International Searching Authority, International Search Report and Written Opinion, International Application No. PCT/US14/12456, mailed May 14, 2014.

(Continued)

*Primary Examiner* — Scott A. Smith
(74) *Attorney, Agent, or Firm* — Paul Y. Feng; One LLP

(57) ABSTRACT

A flat clinch assembly fits upon or within a base of a stapling device. The assembly preferably includes a slot with extended resiliently biased arms or toggles, where a rest position has the arms at or near a level of a working surface. An ejecting staple deflects and energizes the arms to cause the arms to rotate and create a clearance recess whereby points of the staple legs slide inward along the anvil. A restorative bias acting on the arms causes the arms to rebound to a rest position and to bend the legs upward. The legs thereby are normally pressed flat against the back sheet of a paper stack at the working surface. The arms or toggles are lightweight whereby the inertia of a fast moving staple moves the arms or toggles.

22 Claims, 6 Drawing Sheets

(58) Field of Classification Search
CPC .. B25C 5/163; B25C 5/08; B25C 5/11; B25C 7/0071; B25C 5/0228; B25C 5/0264; B27F 7/19; B27F 7/21
USPC ..... 227/140, 143, 149, 153, 155, 131, 129, 227/82, 134, 132
See application file for complete search history.

(56) References Cited

U.S. PATENT DOCUMENTS

| | | | | |
|---|---|---|---|---|
| 1,169,339 | A | 1/1916 | Maynard | |
| 1,252,011 | A | 1/1918 | Maynard | |
| 1,612,870 | A | 1/1927 | Leschhorn | |
| 1,773,823 | A | 8/1930 | Polzer | |
| 1,810,528 | A | 6/1931 | Peterson | |
| 1,852,060 | A | 4/1932 | Peterson | |
| 1,859,951 | A | 5/1932 | Blevney | |
| 2,267,185 | A | 12/1941 | Bauwens | |
| 2,320,703 | A | 6/1943 | Maynard | |
| 2,987,729 | A | 6/1961 | Taynton | |
| 4,194,666 | A | 3/1980 | Spehrley, Jr. et al. | |
| 4,449,661 | A | 5/1984 | Spehrley, Jr. et al. | |
| 4,593,847 | A | 6/1986 | Hagemann | |
| 4,716,813 | A | 1/1988 | Prudencio | |
| 4,844,319 | A | 7/1989 | Kurosawa | |
| 5,004,142 | A | 4/1991 | Olesen | |
| 5,029,745 | A | 7/1991 | Akizawa et al. | |
| 5,038,992 | A | 8/1991 | Shiang et al. | |
| 5,098,002 | A | 3/1992 | Hansch et al. | |
| 5,516,025 | A | 5/1996 | Eriksson | |
| 5,586,710 | A | 12/1996 | Golicz | |
| 5,678,745 | A | 10/1997 | Yoshie | |
| 5,758,813 | A * | 6/1998 | Kikuchi | B25C 5/0271 227/134 |
| 6,036,074 | A | 3/2000 | Manabe | |
| 6,056,183 | A | 5/2000 | Tanabe | |
| 6,164,513 | A | 12/2000 | Yoshie | |
| 6,193,126 | B1 | 2/2001 | Lee | |
| 6,371,352 | B1 | 4/2002 | Mochizuki | |
| 6,637,635 | B2 | 10/2003 | Borjesson et al. | |
| 6,820,790 | B2 | 11/2004 | Ura | |
| 6,981,626 | B1 | 1/2006 | Tsai | |
| 6,981,627 | B2 | 1/2006 | Tsai | |
| 7,044,349 | B2 | 5/2006 | Adams et al. | |
| 7,108,165 | B2 | 9/2006 | Tsai | |
| 7,111,378 | B2 | 9/2006 | Aldana | |
| 7,124,925 | B2 | 10/2006 | Ishizaki | |
| 7,124,926 | B1 | 10/2006 | Tsai | |
| 7,228,999 | B2 | 6/2007 | Oide et al. | |
| 7,334,716 | B2 | 2/2008 | Tsai | |
| 7,621,433 | B2 | 11/2009 | Ivarsson | |
| 7,644,851 | B2 | 1/2010 | Sugihara et al. | |
| 7,665,645 | B2 | 2/2010 | Smith et al. | |
| 7,832,609 | B2 | 11/2010 | Matsukawa | |
| 7,938,306 | B2 | 5/2011 | Sugihara et al. | |
| 9,114,518 | B2 * | 8/2015 | Aoki | B25C 5/0207 |
| 2003/0000992 | A1 | 1/2003 | Borjesson | |
| 2004/0262363 | A1 | 12/2004 | Elonsson et al. | |
| 2005/0077338 | A1 | 4/2005 | Ishizaki | |
| 2005/0269380 | A1 | 12/2005 | Shimizu et al. | |
| 2006/0273134 | A1 | 12/2006 | Smith et al. | |
| 2007/0023474 | A1 * | 2/2007 | Smith | B25C 5/0207 227/155 |
| 2007/0210135 | A1 * | 9/2007 | Ivarsson | B25C 5/0207 227/134 |
| 2007/0210136 | A1 * | 9/2007 | Sugihara | B27F 7/19 227/155 |
| 2009/0072003 | A1 * | 3/2009 | Matsukawa | B25C 5/11 227/120 |
| 2009/0152318 | A1 * | 6/2009 | Matsukawa | B25C 5/0207 227/129 |
| 2010/0096430 | A1 * | 4/2010 | Sugihara | B27F 7/19 227/155 |
| 2011/0062210 | A1 | 3/2011 | Leung | |
| 2013/0001269 | A1 | 1/2013 | Aoki | |

FOREIGN PATENT DOCUMENTS

| | | | |
|---|---|---|---|
| CN | 201257810 | Y | 6/2009 |
| CN | 101722502 | A | 6/2010 |
| CN | 101811296 | A | 8/2010 |
| CN | 102848353 | A | 1/2013 |
| DE | 4434513 | | 8/1995 |
| EP | 0597782 | | 5/1994 |
| KR | 10-2010-0043021 | A | 4/2010 |

OTHER PUBLICATIONS http://www.bostitchoffice.com/news/detail.php?id=29.
TW, 103102294 Official Letter, Jul. 11, 2016.
TW, 103102294 Search Report, Jul. 11, 2016.

* cited by examiner

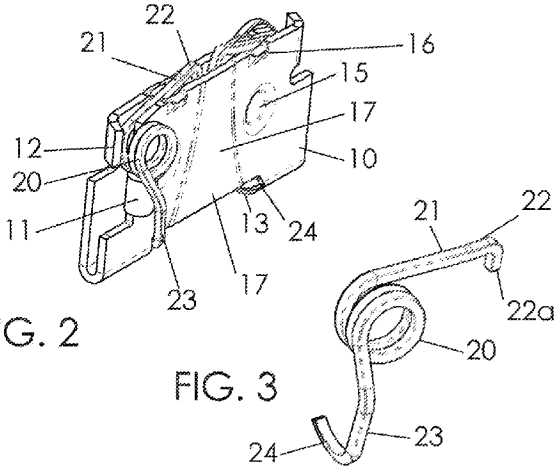
FIG. 2
FIG. 3
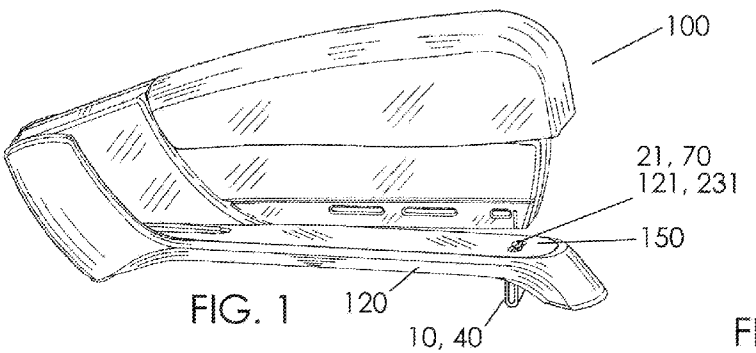
FIG. 1
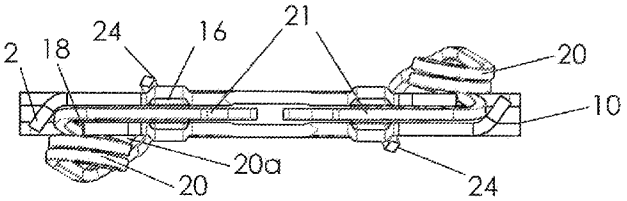
FIG. 4
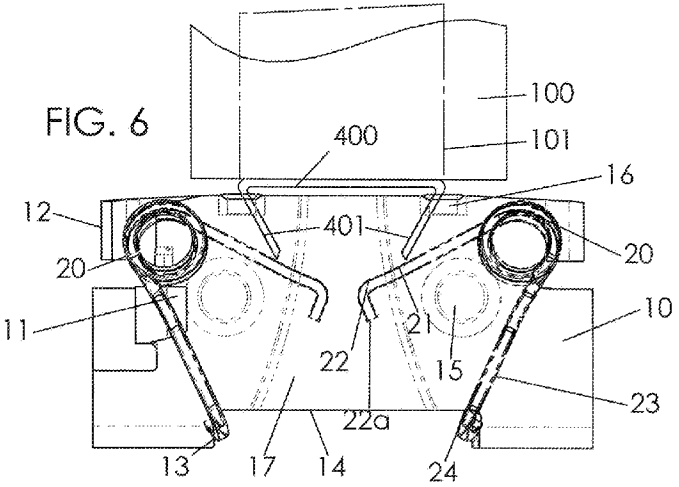
FIG. 6
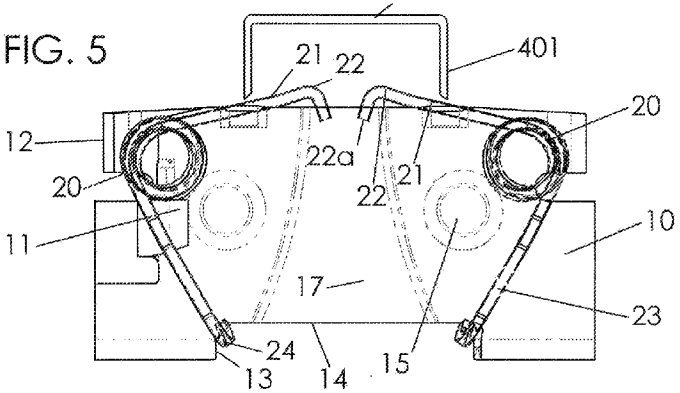
FIG. 5

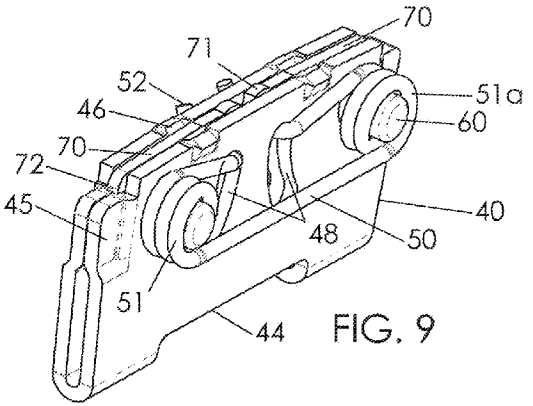
FIG. 9
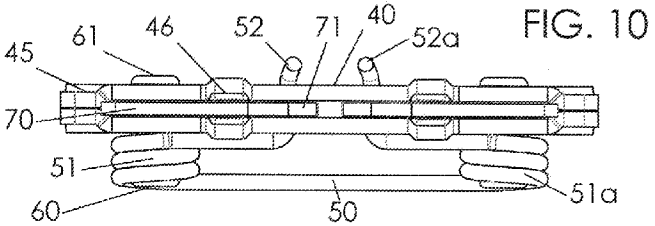
FIG. 10
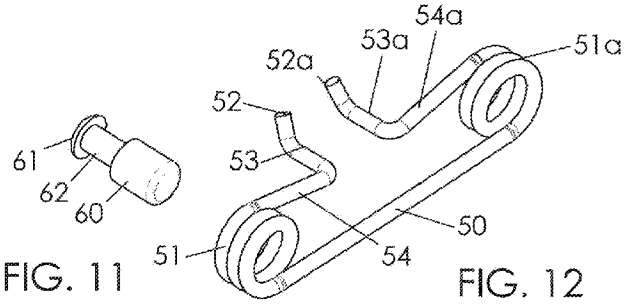
FIG. 11
FIG. 12
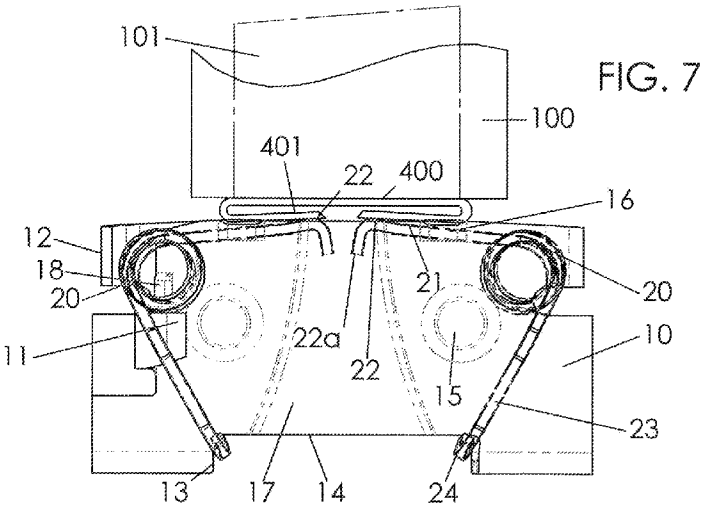
FIG. 7
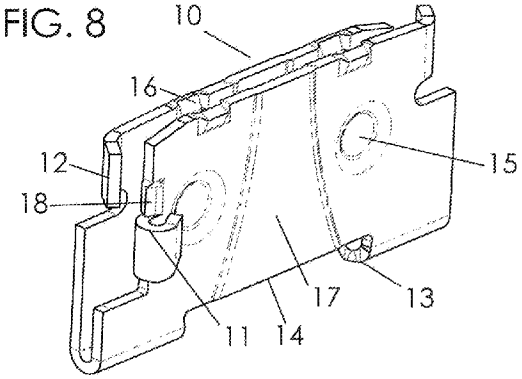
FIG. 8

FLAT CLINCH STAPLER ANVIL ASSEMBLY

CROSS-REFERENCE TO RELATED APPLICATIONS

This non-provisional patent application claims benefit of priority from U.S. provisional patent application No. 61/755,894, filed on Jan. 23, 2013, the contents of which are incorporated by reference.

FIELD OF THE INVENTION

The present invention relates to improvements to stapling. More precisely, the present invention relates to a mechanism for flat clinched staple legs.

BACKGROUND

In desktop or other office and related type staplers, an anvil operates below a stack of papers to bend staple legs behind the paper. Such clinching binds the papers together. A typical anvil is made of a hard steel plate including two adjacent arcuate depressions. During the stapling process, the staple legs enter an outer portion of the depressions and slide within the depressions to form a rounded or looped clinch. The legs are formed at the same time that the staple is being ejected from the stapler. This system is simple and normally effective for binding papers. However, the looped legs protrude from the face of the backside of the paper stack. As a result, the stack becomes thicker at the location of the staple. When multiple stapled paper stacks are stored together, as in a file cabinet, folder, or binder, the corners with the looped staples fan out whereby the adjacent stack is pushed away by the staple loop at the corner. The capacity of document storage thus becomes reduced.

Forming the loop also uses excess extra energy since the wire is bent upon an extended portion of its length. Further, the maximum thickness of a paper stack is limited since a very short leg segment cannot be looped. For example, a loop type form with a standard 26/6 staple may be limited to about 30 sheets of 20 lb. paper in a best case.

Another type of clinch is of a flat configuration. The staple leg remains relatively straight as it is bent behind the stack. An advantage of this design is a more compact assembly of stacks. The staple legs are substantially parallel and adjacent to the backside paper face whereby adjacent stacks can rest very near to each other at the staple location. An assembly of flat clinched stacks thus is more compact in storage than that of looped staple stacks. The straight segment may allow binding up to 40 sheets with a high quality standard size staple. Further, to some consumers, a flat clinch is of better appearance than a loop type.

A typical flat clinch design operates in two distinct stages. In a first step the staple is ejected from the stapling device. The staple legs are pushed through the papers to extend from the backside straight out or partially pre-bent by an element of the anvil. A second step has the legs being fully bent against the stack backside by an externally powered component. According to this procedure, the bending step must be timed in relation to the first ejection step through a timing action external to the base. Therefore, the staple ejecting mechanism, for example, in the main body portion of a desktop stapler, must be operatively linked to the base portion that includes the anvil. In the case of a manually-operated stapler, for example, the second step starts at a predetermined position of the handle with a conspicuous clunk. Further, this linkage is mechanically complex. Such connection also normally precludes an option to open the base away from the body for use as a tacker since the body and base are tied together by this flat clinch linkage. An electric powered stapler similarly requires complex linkages in typical flat clinch designs to link the motor to the secondary clinching action. It is therefore desired to have a flat clinch stapler with a simplified design wherein the clinching action is enabled primarily or entirely within the base.

SUMMARY OF THE INVENTION

In a preferred embodiment of the present invention, a stapler includes a simplified flat clinch mechanism. The sequence of clinching actions including bending the staple legs is enabled or triggered by the position or motion of those staple legs. In this respect the action is similar to a basic loop type anvil where the movement of the staple legs inherently causes the legs to bend. However, in the preferred embodiment, there are separately movable elements in the anvil that act sequentially upon the legs as a direct result of the leg motion.

In the preferred embodiments, the anvil includes a slot or equivalent structure to receive staple legs. In preferred embodiments reciprocating arms are pivotally mounted at each end of the slot, extending within the slot toward the center of the slot. The arms are resiliently biased, as by a spring, toward the top of the slot with the arms having a normal rest position flush or nearly so with the top of the slot. The nearly flush condition may include the arms being above or below the top of the slot or equivalent structure. An ejected staple impacts and deflects the arms momentarily downward. The arms then return toward their rest position to flick the staple legs up against the paper face. The staple legs thus may effectively create a temporary anvil cavity where there normally is not one. This feature contrasts with conventional flat clinch designs where the anvil cavity is normally present before the staple legs enter it. In such prior designs, the legs enter with minimal or no contact with structures of the anvil; although slight initial bending may occur. The legs are next fully bent up to be clinched by way of actions external to the anvil area.

As described above according to one aspect of the invention, the arms or other movable structure that deflect the staple legs are directly moved and/or energized by the staple legs rather than by further linkages or structures external to the anvil area, although such connections may be used if desired. For example, there is no need for a connection to a stapler body, handle, motor or other such elements to move and energize the deflecting structure.

For effective operation of the flat clinch anvil, the staple should preferably be ejected at high speed. For example, a spring-energized stapler will provide such high-speed action. Optionally, a solenoid powered electric stapler may also provide suitable high-speed action. For the deflecting arms to operate efficiently the structure thereof should be, in the preferred embodiment, lightweight in relation to the staple wire. For example, a wire or thin metal strip that fits within the slot will be lightweight. High-speed motion combined with lightweight or low inertia arms allows the arms to deflect primarily or exclusively from the energy of the moving staple. Preferably the reciprocating mass of a toggle arm and linked moving parts are not great in comparison to the staple mass that actuates the system, for example a multiple of less than 5 or 10 times the staple weight.

In various embodiments, the arms may be constructed directly from the arms of a torsion spring. Preferably a square or rectangular wire is used to provide a flat upper surface to engage the staple leg point. Spring wire is naturally of a hard steel type that resists wear from the staple legs. In a further alternative embodiment, the arms may be constructed from rigid hardened steel parts and biased by a separately mounted spring. The rigid steel parts can be separately hardened to withstand harder staple wires such as those used in high capacity staplers if such extra hardness is desired. In any case, the structures of the preferred embodiments allow minimal reciprocating mass, and thus inertia, so the momentum of a staple can create useful motion and effects upon the working parts of the anvil assembly. In this manner there is no need for external linkages beyond the ejecting staple to actuate the system. For the torsion wire spring, it is preferred that the weight of the reciprocating arm is comparable to that of a staple—for example, within a similar order of magnitude, although other weight ratios may be used.

The flat clinch assembly according to one embodiment of the invention may be contained entirely within a forward portion or other suitable area of the stapler base. There need be no external links from the anvil assembly to internal or other operative parts of the stapling device. Among the benefits of this feature is the base can be rotated away from the body in a familiar way. For example the only substantially required link between the anvil area and the stapler body is the normal pivoting or equivalent link to the base while the toggle arms of the anvil assembly may operate independently from any motion at the base to body pivot. This link in the normal way serves primarily to position the body above the base. The stapler can then be used as a tacker. In contrast, conventional flat clinch staplers cannot be opened this way since the link between the body and the base that actuates the secondary clinching action ties the base to a limited movement in relation to the body. Further, the independent assembly of the preferred embodiment anvil assembly may be inexpensively fitted to a variety of conventional staplers with no substantial modification to such staplers.

BRIEF DESCRIPTION OF THE DRAWINGS

FIG. 1 is a side perspective view of an exemplary stapler incorporating an anvil assembly in accordance with a preferred embodiment of the present invention.

FIG. 2 is a perspective view of a flat clinch anvil assembly in a rest condition according to one embodiment of the invention.

FIG. 3 is a perspective view of a torsion spring of the assembly of FIG. 2.

FIG. 4 is a top view of the anvil assembly of FIG. 2.

FIG. 5 is a side elevational view of the anvil assembly of FIG. 2, with a staple located above, just before the clinching action.

FIG. 6 is the assembly of FIG. 5 in a deflected condition.

FIG. 7 is the assembly of FIG. 5 in a pressed condition.

FIG. 8 shows the frame of the anvil assembly from FIG. 2.

FIG. 9 is a perspective view of an alternative embodiment flat clinch anvil assembly in a rest condition.

FIG. 10 is a top view of the anvil assembly of FIG. 9.

FIG. 11 is a perspective view of a rivet post.

FIG. 12 is a perspective view of a bias spring from the assembly of FIG. 9.

FIG. 28 is a top view of one element of the two part assembly.

FIG. 29 is a side elevational view of the element of FIG. 28 in a rest condition.

FIG. 30 is the element of FIG. 29 in a deflected condition.

FIG. 31 is a perspective view of the element of FIG. 29.

FIG. 32 is an exploded view of internal components of the anvil element.

FIG. 33 is an assembly of two anvil elements to form an offset anvil assembly.

FIG. 34 is an opposed side perspective view of the element of FIG. 30.

DETAILED DESCRIPTION OF THE PREFERRED EMBODIMENTS

Figure 14:
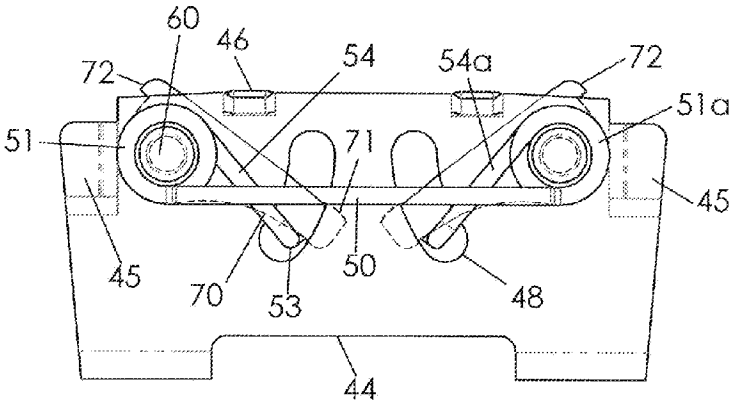
FIG. 14 shows the anvil assembly of FIG. 13 in a deflected condition.
Figure 16:
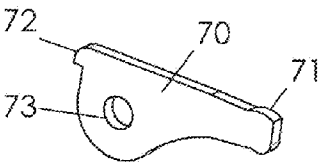
FIG. 16 is a perspective view of a solid toggle arm from the anvil assembly of FIG. 15.
Figure 13:
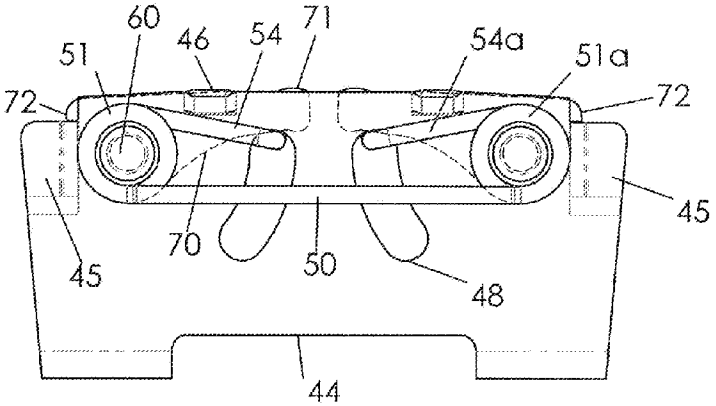
FIG. 13 is an elevational view of the anvil assembly of FIG. 9.
Figure 15:
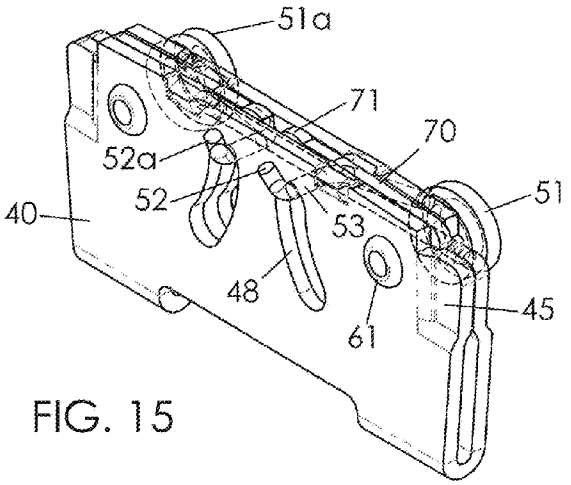
FIG. 15 is a perspective view of the anvil assembly of FIG. 9 showing the opposite side.

FIG. 1 shows an exemplary desktop stapler 100 including a stapler body supporting operative components with exemplary frame 10, 40 of a flat clinch anvil assembly fitted to stapler base 120. Other anvil frames and assemblies as illustrated or anticipated by the invention may be fitted to base 120 although the assemblies of FIGS. 2 to 16 is used in for simplicity in the present context of stapler 100. The stapler body is able to eject staple fasteners toward the base during an operating cycle of the stapler. During such operating cycle (not shown), a staple fed from a rack advanced on a guide track is suddenly ejected from the stapler body by impact blow. The stapler operative cycle may be of a type, for example, disclosed in U.S. Pat. No. 6,918,525 (Marks), titled "Spring Energized Desktop Stapler," which contents are incorporated by reference. A space between the stapler underside and the base is able to receive papers or stacked sheet media to be stapled. The stapler pivots or moves toward the base, for example, at a pivotal attachment of the base to the body (not shown) generally toward a rear of the stapler. Clinch arms 21, 70 are visible at cover plate 150. Stapler base 120 may include a housing or a covering structure (not shown) to fully or partially enclose frame 10, 40 so that the anvil assembly is not exposed under the base 120.

Stapler 100 may be spring energized, electrically powered, or direct driven, and the like known in the art. In a typical spring energized stapler, striker 101 (FIG. 6) suddenly and rapidly ejects a staple 400 out from the stapler body by impact blow through the action of operative components within the body such as those disclosed in, for example, U.S. Pat. No. 6,918,525 (Marks). It is contemplated that the present invention flat clinch anvil assembly be fitted to a new stapler and sold, be sold with a base to retrofit an existing stapler, or be sold by itself to retrofit the existing anvil of a stapler, or any combination thereof.

FIGS. 2 to 8 show a first preferred embodiment of a flat clinch anvil assembly. Frame 10 having two spaced apart walls supports preferably two torsion springs 20. Springs 20 are preferably identical for convenience and arranged in opposed co-planar positions on the frame 10 as seen in FIGS. 5-7. Springs 20 are in a free position, without preload, in the rest condition shown in FIGS. 2 and 5. In this condition, spring arms 21 are near to but slightly above the working surface as may be defined by a top of frame 10. In other words, the working surface is the level of a bottom sheet of a paper stack (not shown) when the stapling or clinching action occurs.

In FIG. 5, staple 400 is being ejected from stapler 100 or equivalent device (not shown). Staple legs 401 of staple 400 are about to impact arms 21 of coil springs 20. In FIG. 6 staple legs 401 deflect spring arms 21 downward as striker 101 ejects staple 400 to at least partly create a recess with clearance below the working surface, within the anvil assembly, for staple legs 401. Arms 21 become angled so that legs 401 slide inward along arms 21. It is possible that arms 21 may deflect downward farther than shown in FIG. 6, beyond the ends of legs 401 from the momentum of the action. Whether so deflected or as shown in FIG. 6, spring arms 21 are biased to rapidly rise to the pressed condition of FIG. 7.

In FIG. 7 the resilient spring arms 21 rebound to impact or force staple legs 401 to deform and close staple 400 in the flat clinch configuration shown. The energy for the rebound is primarily or entirely from that provided by the preceding spring deflection caused by ejected staple 400. FIG. 7 is referred to as pressed, because the body of stapler 100 is still holding arms 21 generally flush with the working surface. This arm position is below the working surface as compared to that shown in the rest condition of FIG. 5. Thus, coil springs 20 are arranged in the frame 10 such that the arms 21 in FIG. 7 are temporarily preloaded to help force legs 401 closed and preferably tightly clinched against the paper stack. The staple 400 of FIG. 7 corresponds to a small stack of papers (not shown). A larger stack will naturally leave shorter leg segments to fold. The illustrated assembly design has been demonstrated and empirically observed for paper stacks of between 2 to 30 pages of 20 lb. type paper, while other capacities and paper thicknesses are contemplated. Alternatively, the rest condition may have arms 21 being generally flush with the working surface where momentum of the arms may still properly fold the staple legs to the condition of FIG. 7, as discussed for FIGS. 21 to 25. In one working example of spring 20, the wire is of about 0.04 inch square with about 2.5 revolutions in the coil, although other wire sizes, shapes and windings are contemplated.

The present illustrated anvil assembly preferably includes only three components: frame 10 and two springs 20. Rivets (not shown) may be used at recesses 15 to bond the frame. As seen in FIG. 4, arm 21 of spring 20 is held within the slot of frame 10 while the spring coil is situated beside and outside the slot. In spring 20 as seen in FIG. 4, the coil includes spaced apart portion 20*a* to allow the coil to fit on an edge of frame 10 at chamfer 18, as seen in FIGS. 4, 8. Tab 11 of the frame 10 supports the coil of the spring from below. Tab 11 and the edge at chamfer 18 together support the coil as spring 20 operates.

During the clinching action, the coil of spring 20 encounters a downward force from the staple leg 401 and an inward force from the reaction to end hook 24 against edge 13. So tab 11 biases the coil 20 upward while the frame edge 13 biases the coil 20 outward. Chamfer 18 corresponds to the local helical angle of the coil wire so that the wire does not press a sharp edge. This minimizes excessive wear and potential cyclical malfunction or failure. The structure described here allows for arm 21 to move generally freely and to extend within and be guided by the slot up to the coil position. Further, this illustrated embodiment frame assembly requires no additional components beyond the two springs 20 the frame 10 and optional rivets. Tab 12 confines coil 20 from the outside of frame 10. For assembly during production, spring 20 is installed from above and one or both of end hook 24 and arm 21 are snapped into their respective positions. Alternatively, a post attached to frame 10 may support coil 20 as shown below.

The slot of frame 10 is preferably open at the top between coils 20 or equivalent pivot locations of arms 21. For example, there is no tab crossing the top of the slot. This prevents jamming in the case of a stapler misfire where, for example, a staple leg extends outward. If there were a bridge such as a tab atop arm 21, staple leg 401 may become trapped by arm 21 under the tab. This has in fact been observed in such a model. However, if a gap is maintained between a bridge across the slot and spring 20, not shown, by for example a suitable spring rest position that does not press such a bridge then staple leg 401 can remain free to pull out.

To provide the open top structure, the preferred embodiment frame 10 may be formed as illustrated. A sheet metal form is bent at a bottom with recessed embosses 15 defining the gap distance of the slot. Embosses 15 may be spot-welded, riveted or otherwise bonded to hold the shape of frame 10. Bonding is performed preferably before heat treatment so that the frame maintains its shape during that process. Alternative types of spacers, shims, or shouldered rivets may be used in place of or in addition to embosses 15 to hold the shape of frame 10. Likewise, frame 10 may be of two opposed halves that are bonded as shown in FIGS. 21 to 25. Optional chamfered entry location 16 extends partly as shown or fully along the top of the slot to increase tolerance for the position (i.e., vertical direction on the page in FIG. 4) of ejected staple 400.

From empirical observations, the slot is preferably between about one to three times the width of an applicable staple wire, or between about 0.02 inch to about 0.07 inch for a standard staple; slot dimensions inclusive of the end limits and all widths in between the end limits are contemplated. In an exemplary working model, the slot is more preferably about two to three times the staple wire diameter or width. Other widths may be used when suited. Embosses 15 should preferably be positioned as close as possible to the staple entry area, shown at chamfer 16, to rigidly hold the size of the gap of the slot. However, embosses 15 or their equivalent structures should be positioned to clear all operative positions of arm 21.

It is desirable that there be some preload in spring arm 21 when it is in the pressed position at the level of the working surface as in FIG. 7. As discussed above, there is no bridge tab over arm 21, so there may be no immediate way to confine the arm 21 of spring 20 with a preload by the frame in the pressed position. Therefore, in the rest position of FIG. 5, arm 21 freely extends above the working surface. Then arm 21 deflects slightly to become preloaded as stapler 100 moves against base 120 as in FIG. 7 (base 120 not shown). As spring arms 21 are free to extend above the working surface, this surface being the top of frame 10 in this example, bent spring leg 22*a* extends into the slot (see FIGS. 3, 5-7). This prevents a cantilevered end of spring arm 21 from snagging papers and other things. In alternative embodiments shown below an end of bent spring leg 22*a* or other part of the spring 20 may engage a tab or feature of frame 10 to hold an elastic preload in spring 20 and thus have a rest position closer to that of FIG. 7.

As seen in FIGS. 3 and 5, a small hump 22 may optionally be included at the end of arm 21. This hump 22 helps bend staple legs 401 when applied to small paper stacks when the staple legs 401 to be bent are long enough to be impacted by humps 22. Humps 22 also hold spring arms 21 to a more downward angle when pressed by stapler 100 to the pressed position of FIG. 7. This can increase the reliability of the staple legs 401 folding inward, especially at higher page counts where the extended leg is short. By angling the spring arm slightly downward, the humps allow a longer extension of the staple leg before contact to the spring arm. The added downward angle also helps direct the leg in the correct inward direction. The legs can then bend more easily. At the same time the short leg does not press the hump, with the hump being inward of the short legs. The hump thus moves higher than the leg to press the backside of the paper stack. The outer, lower part of the spring arm, near chamfers 16 in FIG. 7 can then press firmly against the staple short leg. If FIG. 7 is considered to have a short staple leg as with a thick stack, not shown, then it can be seen that this leg will terminate before hump 22 with hump 22 free to pass higher than the short staple leg.

Frame 10 may include protruding emboss 17 on one or both sides at least partly corresponding to the positions of bent spring legs 22*a*. This allows for some tolerance for slight misalignments in the bend. Likewise, the inside of the spring wire bend will thicken during fabrication from normal metal flow, and emboss 17 allows clearance for that as needed.

As seen in the drawing figures, the wire of spring 20 is preferably of a square or rectangular cross-section, referred to here as square for brevity. Rectangular cross-section further includes flat type springs in this example. The square cross-section includes a flat face oriented upward in the slot as seen in FIG. 4. This is a secure surface for the point of leg 401 to press. A round wire spring may also be used and is contemplated, but may tend to bias the point toward one side of the slot adding friction or reducing reliability. A rounded wire face also presents a smaller contact surface for the staple wire at the staple point, which may increase wear on the wire. Therefore, spring 20 may be fabricated from a square cross-sectioned spring wire as shown. The wire may also be of a D-shaped cross-section or other arcuate and/or polygonal cross-sectional shapes (e.g, pentagon, hexagon, etc.) where a flat portion of the cross-section may preferably face upward or toward the staple leg 401.

The flat clinch systems disclosed herein operate best and reliably when friction is reduced. This best preserves the energy of the driven staple to operate arms 21 or equivalent structures and the energy for the rebound. Therefore, preferably hooked end 24 crosses past the frame slot so that lower arm 23 of spring 20 presses frame 10 at a plane aligned with arm 21 and the slot. When so aligned, pressing down on arm 21 creates an opposed reaction at hooked end 24 that is substantially directly aligned, or planar, with the slot. There are minimal sideways forces, up and down in FIG. 4, and thus friction on arm 21.

A further feature to reduce friction is to provide an optional coating to the elements of the assembly. For example, the spring arms or other toggle elements may be plated with nickel, chrome, or similar low friction coating or material. Then the staple legs may better slide upon the toggle to more easily fold. Similarly, the frame structure may be plated or coated to reduce friction from supported moving parts. The hard surface plating also reduces wear of the components. Plating further improves the appearance of the assembly. Coatings contemplated here include suitable lubricants such as grease or dry film.

As seen in FIG. 5, the rest position has lower arm 23 and upper arm 21 at about 90° relation or slightly less. In the deflected position of FIG. 6, spring arms 21, 23 are approaching parallel and extending in the same direction although not entirely at parallel, being for example about 20° relation. As spring arms 21, 23 become more parallel in the same direction, the net force on coil 20 decreases. To demonstrate this concept, one may consider spring arm 23 being supported on a frame while extending outward, also parallel but away from the other arm (not shown). Then a downward force on spring arm 21 causes a similar downward force on such outward spring arm 23. The resulting effect is like a lever comprising the spring with the coil being the fulcrum. Naturally there is a substantial downward force on the coil; in fact it is double that of the force at arm 21 when arms 21 and 23 are the same length according to basic lever concepts. This configuration would cause substantial friction at the coil as it moves and deflects upon the frame. So as best illustrated in FIG. 6, the near parallel spring arms 21, 23 create largely opposed forces, which nearly cancel each other at coil 20 in the deflected position of FIG. 6. However, there remains a sideways acting force on the coil in the rest position of FIG. 5 as the staple presses down on arms 21 since arms 23 have a corresponding outward force pressing the frame at edge 13.

Frame 10 preferably includes open bottom portion 14. This provides edge 13 for holding lower arm 23. Such an opening may also help clear any staple jam. For example, if staple 400 is caught under spring arms 21, 23, it can be forcibly pushed out through opening 14. However, it is not anticipated that this condition or required action would be common.

FIGS. 9 to 16 show an alternative second embodiment of the present invention. In this embodiment, a substantially rigid or solid toggle 70 is biased by external spring 50 on frame 40. As with the first illustrated embodiment, a staple (not shown) impacts toggle 70 where the toggle begins at or near the level of the working surface. Toggle 70 (FIG. 16) is a formed or stamped metal part pivotally mounted to frame 40 at hole 73 of the toggle about neck 62 of post 60 (FIG. 11). Double torsion spring 50 (FIG. 12) is mounted at coils 51 and 51*a* to respective posts 60. So in this case the resilient energy storage for moving the toggle arms is primarily in a spring structure separate from the solid arm structure. Hooks 53 and 53*a* with bent ends 52 and 52*a* extend through openings 48 of frame 40 to press and bias toggles 70 from below. Arms 54 and 54*a* of spring 50 rotate with the toggles 70. In the rest condition of FIGS. 9, 10 and 13, toggles 70 are positioned at the working surface at or near the top of frame 40. In this rest position, spring 50 may retain a preload as tab 72 of toggle 70 contacts a shelf of frame 40 whereby tab 72 or equivalent structure provides an upper stop limit for toggle 70. Therefore, the preload persists whether or not stapler 100 (not shown) is adjacent (and the paper stack is abutting) frame 40. Optional hump 71 in toggle 70 moves the toggle downward slightly when pressed by the stapler to provide a more inward angle to the toggle, having the same effect as discussed above regarding hump 22 of the first embodiment.

In the present embodiment, toggle 70 may be hardened to the practical limit of the constituent steel. For typical carbon steel, this will be, for example, between 50 to 60 Rc hardness inclusive of the end limits and all values in between, with certain alloy steels allowing higher hardness values. In the case of arm 21 of spring 20, the limit may be defined by that of the spring wire from which it is made, where certain constraints on hardness may be present. The potentially harder discrete toggle 70 may be useful for harder high carbon staples as are used in high capacity staplers or other applications. Toggle 70 may be of stamped form or of a bent wire form, where such wire may be hardened after it is formed. Toggle 70 may be of higher mass than arm 21 in some conditions if desired since the toggle may be a taller sheet metal structure compared to a drawn wire arm.

As illustrated, frame 40 is formed in a similar manner as frame 10 above. Outer located crimps 45 may be spot welded, riveted or otherwise bonded to hold the folded metal form in the proper shape. Frame 40 is preferably then heat-treated. In a following step, rivet posts 60 are swaged into place by forming end 61. Other assembly sequences may be used, and as for frame 10 above, the present frame may optionally be formed from two separate halves. Optional chamfers 46 help provide a lead-in for an entering staple leg 401 as shown in FIG. 5.

The method of operation for the present embodiment is similar to that for the first embodiment with frame 10 and springs 20. A staple 400 as shown on FIGS. 5 to 7 is ejected to impact or contact toggle 70 in the rest position. The staple leg 401 deflects toggle 70 to the position of FIG. 14 whereby the staple legs slide inward along the upper face of toggle 70. Spring 50 then restores toggles 70 under spring bias to rebound to the rest position to deform and fold the staple legs flat in a manner as shown in FIG. 7. Spring 50 may optionally be made from two or more components.

For either the first embodiment of frame 10 or the second of frame 40, features of stapler base 120 may help to hold bias springs 20, 50 or other elements in position. In the instance of where arms 21 or toggles 70 have a rest position above the working surface, cover plate 150 (FIG. 1) may be movably mounted to base 120 so that the cover plate portion surrounding or near to the anvil assembly can selectively rise slightly. For example, in FIG. 5, a top face of the cover (not shown) may have a normal position coincident with hump 22. When stapler 100 presses down, both arm 21 and cover plate 150 move down slightly to a predetermined stopping point at the level of the working surface (i.e., the bottom of the paper stack). Since the initial cover plate position is raised, humps 22 or other parts of arm 21 are not protruding above cover plate 150 and so arms 21 or their equivalent structure will not catch on the edge of the papers, installed staples, or other items.

Figure 17:
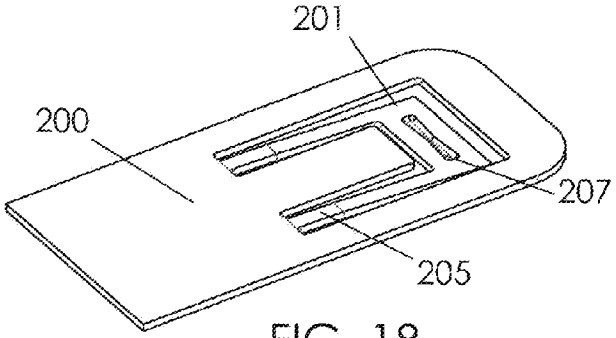
FIG. 17 is a perspective schematic view of a resiliently mounted anvil plate.
Figure 18:
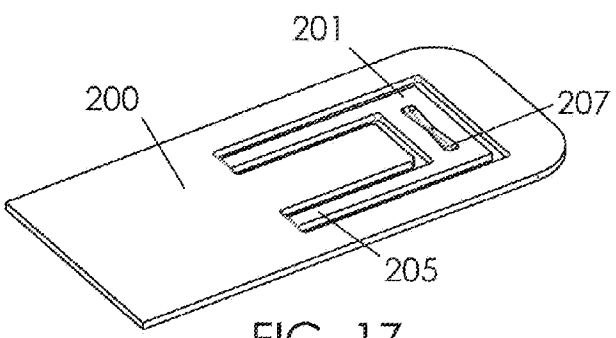
FIG. 18 is the plate of FIG. 17 in a deflected condition.

Further alternative embodiments of the present invention are shown in FIGS. 17 to 20. The embodiments are depicted in the drawings schematically. In the embodiment of FIGS. 17 and 18, anvil 201 with recess 207 operates to guide staple legs inward as well as positioning front to back. Recess 207 may be considered a part of a toggle arm wherein the recess of the arm has a rest position just below a top of the cover plate. Cover plate 200 serves as a frame. Anvil 201 is fitted into a slot of the frame. However, recess 207 is preferably shallower than in a standard loop type anvil form being only deep enough to create a light inward bias on the legs. A lighter bias is possible because the anvil moves resiliently downward from the working surface as in FIG. 18 when a staple (not shown) impacts or presses it. In this manner, the staple legs are not forcibly caused to loop but rather become bent as the anvil rebounds upward. Spring connections 205 provide the resilient action where such springs may be an integral part of the cover plate as shown or discrete spring elements such as a wire spring or flat spring structure (not shown). In FIG. 17, anvil 201 is at the level of the working surface. It may be unloaded or, with suitable connections to surrounding structure, it may be preloaded in the upward direction. Via empirical observations, a structure similar to that shown has been demonstrated to be effective for flat clinching under some conditions. As with the embodiments disclosed above, maintaining a small reciprocating mass to reduce inertia improves results; for example, the anvil area should be as small as possible. In the embodiments of FIGS. 17 to 20, the resiliently moving parts may be considered one or more toggle arms analogous to toggle arms 70 or 21 above.

Figure 19:
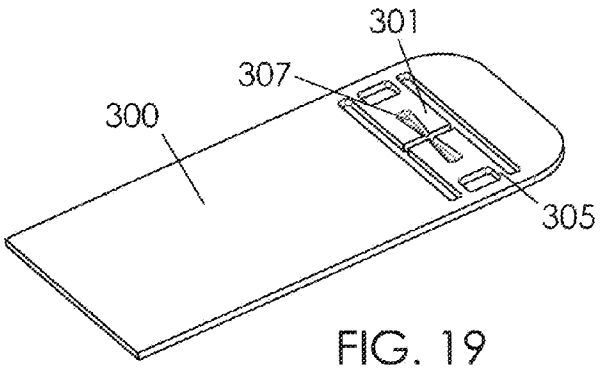
FIG. 19 is a perspective schematic view of an alternative embodiment resiliently mounted anvil plate.
Figure 20:
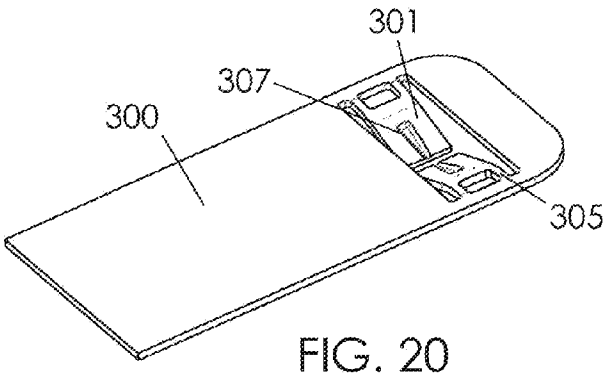
FIG. 20 is the anvil plate of FIG. 19 in a deflected condition.

In FIGS. 19 and 20, a two-part anvil embodiment is shown in cover plate or frame 300. It is hinged to deflect downward in a manner analogous to the embodiments of FIGS. 2 to 16, whereby it returns from the deflected state of FIG. 20 to the rest state of FIG. 19 to bend and clinch the staple legs. In this case, a shallow anvil recess 307 in anvil plates 301 does not need to guide the staple legs inward, although it may do so. Rather, recess 307 primarily holds the front/rear position of the staple legs, i.e., guiding to keep them downward through the cycle. Resilient links 305 provide the bias to anvil plates 301. These elements may be made from torsion, bar, flat, or other discrete spring structures. Anvil plates 301 are small and short in length to be hinged near to their center of mass so the inertia as they move will not be large. As with anvil plate 201, plate 301 may be preloaded upward in the rest condition of FIG. 19.

Figure 24:
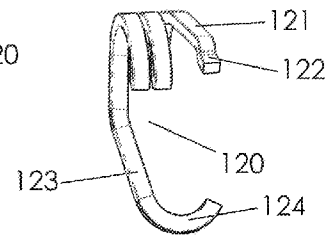
FIG. 24 is a perspective view of a torsion spring of the assembly of FIG. 21.
Figure 25:
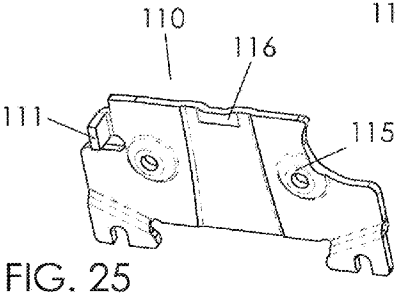
FIG. 25 is a perspective view of a frame half from the assembly of FIG. 21.

FIGS. 21 to 25 show alternate structures to the anvil assembly of FIGS. 2 to 8. Frame 110 includes two, preferably identical, opposed halves of which one half is shown in FIG. 25. Accordingly, the frame comprises small features that are minimally prone to distortion upon heat treat. Further, there is no large fold required to join the frame. Instead, the halves are riveted, screwed, welded, or equivalently bonded together at bosses 115, slots 113 and/or other equivalent locations. Bosses 115 are positioned to clear upper torsion spring arms, or toggle arms, 121 in the deflected position of FIG. 23. This is similar to the clearance shown in FIG. 6 previously. At the same time the bosses are close as practical to the top of the frame to hold the frame rigidly with the required separation at the slot where spring arms 121 fit, see FIG. 21.

Figure 21:
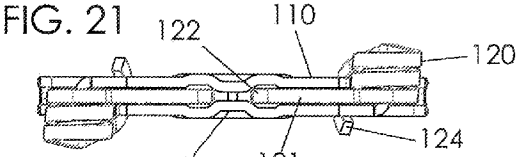
FIG. 21 is a top view of an alternate embodiment of the anvil assembly of FIGS. 2 to 8, in a rest condition.
Figure 22:
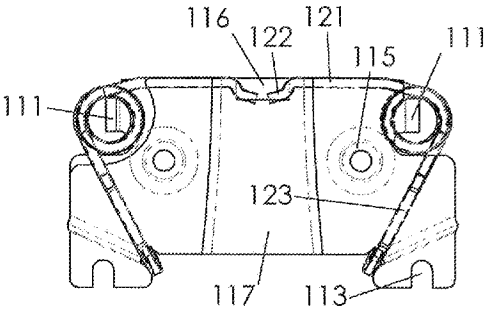
FIG. 22 is a side elevational view of the anvil assembly of FIG. 21.
Figure 23:
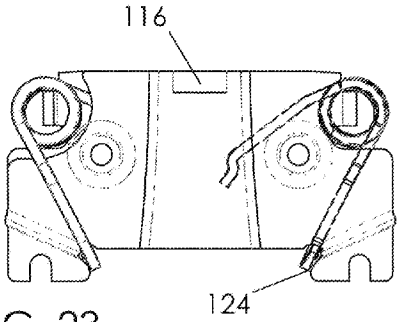
FIG. 23 is the assembly of FIG. 22 in a deflected condition.

Mandrel tab 111, FIG. 22, supports the coil of spring 120 from within the coil. This compares to the under-support seen in FIG. 5 and provides reduced friction since the coil ID moves less against the mandrel compared to the OD surface. The coil also may be a tighter more compact spacing as seen comparing FIGS. 4 and 21. Hooked end 124 at an end of the lower spring arm 123 preferably passes under the vertical position of upper spring arm 121 as seen in FIG. 21. In this manner the vertical force from a staple upon arm 121 is counteracted by vertically aligned hooked end 124. There will thus be minimal out of plane forces, up and down in FIG. 21, on the spring; this reduces friction against the frame.

As best seen in FIG. 24, the spring wire is preferably circular but optionally rectangular in cross-section. This allows a wider frame spacing, the gap into which the spring arm fits, while maintaining a selected wire stiffness. The wider frame slot allows increased tolerance for staple leg positioning. In particular, as the staple exits the stapler of FIG. 1, it will have some tolerance for its lengthwise position, right to left in the Figure. As the paper stack height increases this tolerance will normally also increase. A wider slot in frame 110 thus better ensures the staple will enter the slot and contact the spring arms. A square wire cross-section may also be used in which case increasing the wire width will lead to a stiffer wire which may limit the desired deflection properties, although adding coils to the spring can compensate. As illustrated, the spring has about 2½ coils although more or fewer may be used.

The present exemplary embodiment further includes positive stop 116 for the spring arm. As illustrated, the stop 116 includes an inward crimp in the frame (FIG. 21). The stop allows the spring arms to be pre-loaded while flush or near flush with the top of the frame, as seen in the rest condition of FIG. 22, to present a smooth snag free anvil assembly. Offset arm tip 122 is retained under crimp 116. Other locations to retain spring arm in its pre-load state may be used. In contrast, the spring arms of FIG. 5 have a normal position above a top of the frame. The pre-load in FIG. 5 does not occur until the arms are pressed down by the stapler body, shown after staple ejection in FIG. 7.

There remains a small gap at the crimp as seen in FIG. 21 to allow a staple leg to pull out of the slot as or after it folds over. In comparison, a crimp that fully spanned the slot would form a bridge to trap a staple wire under the crimp and the papers cannot be lifted away. This is especially true when stapling small stacks with a long folded leg as schematically shown in FIG. 7. As long as the spring arm wire and related frame gap is reasonably wider than the staple wire there is room to provide a crimp with a gap that clears the staple wire width, i.e., the crimp area is narrower than the frame gap but wider than the staple wire.

Figure 26:
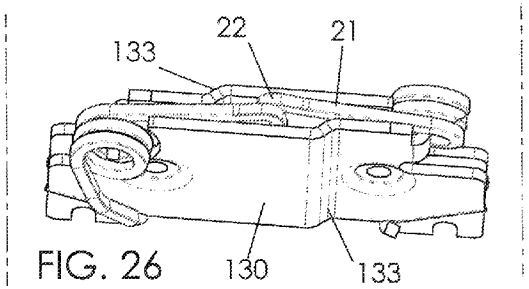
FIG. 26 is perspective view of a further embodiment anvil assembly including an offset toggle arm arrangement.

FIG. 26 shows an embodiment of a flat clinch anvil with a bypass configuration. Toggle arms 21 are similar to that of FIG. 3. However, frame 130 includes offset portions 133 to allow arms 21 to be mounted non-coplanar and pass or aim beside each other. This contrasts with the co-planar or approximately collinear rest position mounting in the other exemplary embodiments above. This design allows for a longer staple leg as commonly used in high capacity staplers. When such legs are folded in-plane in low sheet counts with long leg segments they often will interfere and deform as they fold. For example, a high capacity stapler may operate up to about 65 pages while it is desired to also operate at less than 10 pages. For this lower count a bypass configuration will allow clearance for staple leg folding. Optionally, arms 21 of FIG. 26 may terminate shy of each other although as shown beside each other the arms provide mutual lateral guidance, up/down in the Figure. The anvil assembly of FIG. 26 is normally mounted at an angle relative to the stapler base, shown schematically with vertical dashed lines, so that the staple legs contact both spring arms since the staple legs normally exit in horizontal alignment. In the design of FIG. 26 the toggle spring arms 21 are adjacent to each other with preferably no dividing plate between them. Therefore, the folded bypassed staple arms that result will be near to each other on the rear side of the sheets. Further, the adjacent arms allow the angle of mounting for the assembly to be relatively small for the toggle arms to lie under the staple legs. Further separation of the arms requires further angling.

Figure 27:
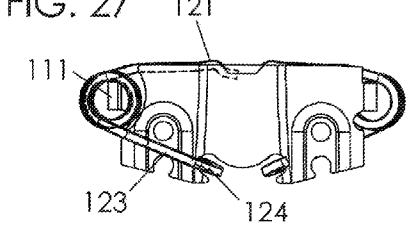
FIG. 27 is an elevational view of a compact flat clinch assembly in a rest condition derived from the embodiment of FIG. 22.
Figure 27A:
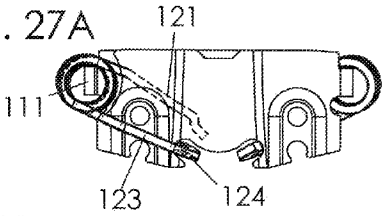
FIG. 27A is the compact assembly of FIG. 27 in a deflected condition.

FIGS. 27 and 27A show a compact version of the assembly of FIGS. 21 to 25. The parts are preferably equivalent to those in FIGS. 21 to 25, however, the frame is less tall and less wide as shown. In addition to the advantage of being compact, the spring arm positions operate more efficiently. As seen in FIG. 27, upper spring arms are relatively parallel to the lower arms that terminate at hooked end 124, having a relative angle of about 20°, for example, or a range of 0 to 30° as a further example. In FIG. 27A, the deflected angle is past just parallel, about 5° as illustrated) to 20° may be used. The upper and lower arms are thus nearly parallel for all operative positions of the spring. This arrangement further reduces friction by better aligning forces vertically with respect to FIG. 27. Specifically, the lower arm counteracts forces in a nearly same but opposed direction to forces on the upper arm. The spring coil at mandrel tab 111 is minimally then biased sideways, left and right in FIG. 27, or otherwise to provide reduced sliding losses at the mandrel and stresses in the spring. For comparison, in FIG. 22 the lower spring leg creates a sideways force as discussed earlier as it reacts against the frame and thus a countering sideways force at mandrel tab 111.

Figure 33:
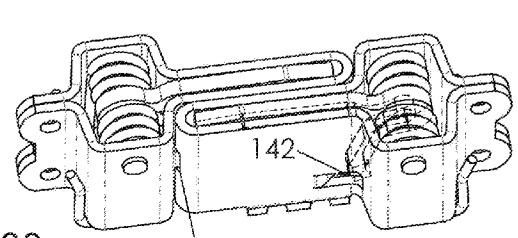
FIGS. 28 to 34 show a two part offset anvil assembly.
Figure 32:
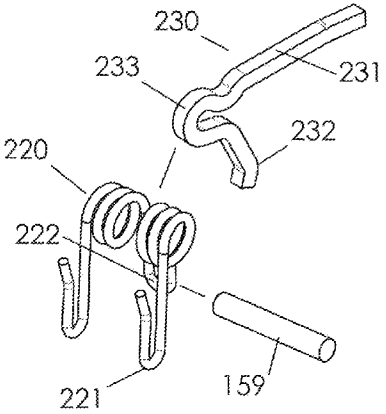
Figure 31:
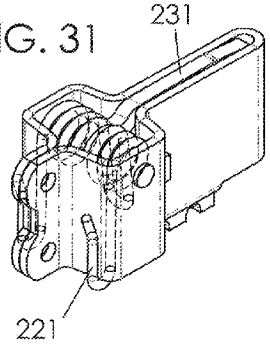
Figure 34:
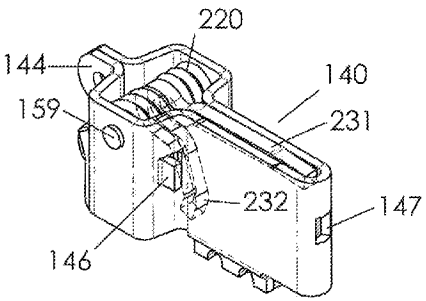
Figure 28:
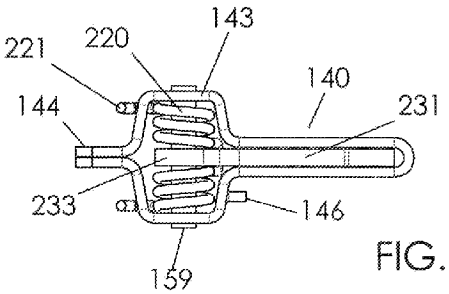
Figure 29:
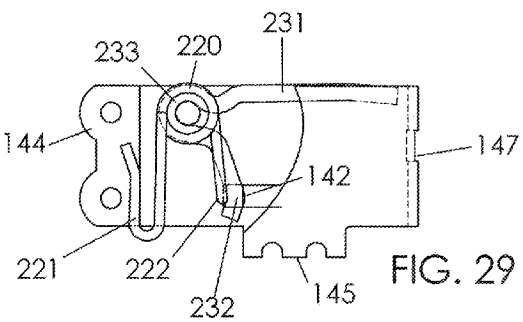
Figure 30:
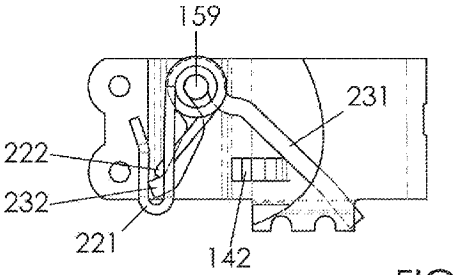

In FIGS. 28 to 34, a bypass flat clinch anvil includes two separate anvil elements. In FIG. 33, the elements are joined to form a complete anvil assembly. For each element, a frame 140 supports and contains a bias spring 220, pin 159, and toggle arm 230. Hook 221 of the spring surrounds a rib of the frame. Loop 222 is opposed on the spring from the hook. The loop normally presses the toggle arm at lower end 232 to pre-load the toggle arm in its rest position of FIG. 29. Stop 142 of the frame limits the motion of toggle arm so that upper arm 231 remains substantially flush with the top of the frame as shown. Bias spring 220 is preferably a double torsion type to store energy in a compact package with a force that is symmetric about toggle arm 220 for a low friction action. Toggle 230 is preferably separate from spring 220 so it may be of a harder material to resist hardened heavy duty staples. As shown, the toggle arm may be formed from a strip material. Loop portion 233 partially surrounds pin 159 to provide a pivot support for the toggle arm. Optionally, toggle 230 may be formed from a stamped blank.

Frame 140 includes tab 146 and recess 147 which mate to hold the elements in the assembly of FIG. 33. Since the frame surrounds the parts, toggles 230 is separated in the assembly by a double layer of the frame material. The mounting angle in a stapler base is adjusted accordingly.

In the exemplary embodiments, the momentum or inertia of a quickly ejecting staple or equivalent fastener deflects moving parts of a flat clinch anvil to an energized position of the parts. The moving parts then re-set or rebound toward the rest position under the restorative force of a resilient bias. During the re-set action, the staple legs are folded upward to become at or near the level of the working surface. According to this action, a downward motion of a staple need not occur at the same moment as the legs are bent, but rather may be at least partly a sequential action. In the preferred embodiments, the staple leg folding process is enabled or controlled by elements entirely or substantially entirely within an anvil assembly with the energy for clinching being provided entirely or primarily by motion of the ejected staple. The moving staple forcibly creates the clearance recess to fit the staple legs where the recess is not normally present. No mechanical link to external actions is needed. Preferred embodiments of the present invention flat clinch anvil assembly are thus much simpler to manufacture by eliminating parts and reducing labor. The flat clinch anvil assembly is also a lot less bulky and can be easily adapted to use in staplers presently on the market without excessive modification and redesign.

Although the preferred embodiments of the present invention are described in a context of a flat clinch configuration, other shapes or bent states for staple legs may be achieved by the present invention. For example, a loop type clinch may be desired where use of the present invention provides improved efficiency. Further, the forming arms may be configured to provide more than a single bend in a staple leg, for example, a short bent segment at an end of a staple leg. In these instances, the pivoting spring arm or toggle may be arcuate or multi-segmented with respect to the side elevation views. Furthermore, as shown in the preceding descriptions, the staple legs may be bent in a bypass manner whereby one leg angles forward on the back of the paper stack while the other angles rearward. This configuration may be useful when a long legged staple is used on a short paper stack so that the two staple legs do not collide when clinched.

In another alternative embodiment (not shown), an external link may be provided for part of a leg folding process. For example, motion of a stapler handle in relation to a body, base or other component, or motion of the stapler body in relation to a base, or other action of the stapler may be linked to the anvil assembly. Such link may cause the resilient features of the anvil assembly to become deflected and energized. In this example, the legs of the ejecting staple may trigger the restorative motion in the anvil assembly to bend the legs. Or a further external action may trigger the restorative bias.

While particular forms of the invention have been illustrated and described, it will be apparent that various modifications can be made without departing from the spirit and scope of the invention. It is contemplated that components from one embodiment may be combined with components from another embodiment.

What is claimed is:

1. A stapler device to install staple fasteners including a clinch assembly and a stapler base, comprising:

the stapler device movably mounted to the base including a space between the base and an underside of the stapler device;

an anvil assembly within the base including a frame of the assembly and slot of the frame in a top of the base; and toggle arms pivotally mounted within the slot, the toggle arms able to contact and fold legs of a moving staple, the arms being resiliently biased by an energy storage spring to rotate upon the frame to a rest position in the slot, an operating cycle of the stapler including moving the toggle arms from a rest position to a deflected position followed by a return to the rest position, the arms being biased by the spring throughout the operating cycle, with the arms having a normal upper rest position flush or nearly flush with the top of the slot, and the arms having a momentary downward deflected position during the operating cycle of the stapler.

2. The stapling device of claim 1, wherein the clinch assembly serves to form staple legs flat against a backside of sheets to be fastened.

3. The stapler device of claim 2, wherein the toggle includes a solid form and a separate spring structure stores energy to move the toggle arms.

4. The stapler device of claim 1, wherein the toggle arms are deflected downward by inertia of contact with legs of a moving staple and the toggle arms are restored to the upper position exclusively by the bias from the energy storage spring.

5. The stapler device of claim 1, wherein two toggle arms are pivotally mounted at ends of the slot, the arms extending toward each other.

6. The stapler device of claim 5, wherein a toggle arm is a leg of a torsion spring, and the leg pivots about a coil of the torsion spring, and the torsion spring leg is exposed along the slot whereby a staple fastener directly contacts a wire of the torsion spring during a normal operating cycle.

7. The stapler device of claim 6, wherein at least the leg of the torsion spring includes a flat sectional shape facing a top of the anvil slot.

8. The stapler device of claim 1, wherein a stapler body is pivotally attached to the base, the body including a first position extending forward from the pivotal attachment spaced above the base and a second body position with the body pivoted away from the base whereby the stapling device is normally used as a tacker.

9. A clinch assembly of a stapler including a body and a base for forming legs of a staple behind a stack of sheets to be fastened, comprising:

the base movably attached to the stapler body;

a frame of the clinch assembly fitted in a top of the base including a slot of the frame;

a toggle arm pivotally attached within the slot and resiliently biased toward a normal upper position near flush with a top of the slot;

the staple being rapidly ejected from the stapler to move against the clinch assembly during an operating cycle, a leg of the staple impacting the toggle arm to deflect the toggle arm downward into the slot against the resilient bias; and the toggle rebounding against the staple leg under the resilient bias to fold the leg upward.

10. The clinch assembly of claim 9, wherein the energy for the rebound is stored in a spring linked to the toggle, and the energy to fold the legs is primarily from that provided to the spring through spring deflection caused by the moving ejected staple.

11. The clinch assembly of claim 10, wherein the moving staple is an exclusive link between the stapler operative components and the toggle arm to provide energy to fold the staple leg.

12. The clinch assembly of claim 9, wherein two toggle arms are pivotally mounted at ends of the slot, the arms extending toward each other.

13. The clinch assembly of claim 12, wherein the arms are substantially co-planar.

14. The clinch assembly of claim 12, wherein the arms aim beside each other.

15. The clinch assembly of claim 9, wherein the leg is folded substantially flat against a backside of a stack of sheets to be fastened.

16. The clinch assembly of claim 9, wherein the toggle arm deflects downward momentarily to form a temporary recess in the top of the base as the staple leg impacts the toggle arm, the toggle arm biased to close the recess after the staple leg impact.

17. A stapler including a base with a clinch assembly for forming staples dispensed by the stapler, comprising:

a stapler body;

a low inertia toggle arm resiliently movable on the base including a normal upper position of the toggle arm and a momentary lower position, the toggle arm operatively linked to at least one spring, the arm thereby being resiliently biased by the spring to cause the toggle arm to rotate toward the upper position defining a spring first position, the spring deflected by the toggle arm to a second spring position during an operating cycle against the resilient bias by impact from a leg of an ejected staple, the lower position creating a temporary lowered position of an anvil cavity in the base into which legs of the staple enter; and the toggle arm, after entry of the staple legs, immediately moving upward toward the normal upper position to close the anvil cavity and fold the legs.

18. The stapler of claim 17, wherein inertia from impact of an ejecting staple deflects the toggle arm to the lower position to energize the spring, the energy for a rebound of the toggle arm is provided by the preceding spring deflection caused by the inertia of the ejected staple, and the rebounding toggle arm folds the legs.

19. The stapler of claim 17, wherein a toggle arm includes an upward facing hump at a distal end of the toggle arm, the hump normally contacting the staple leg during an operational cycle and being an uppermost element of the toggle arm in the upper position.

20. The stapler of claim 19, wherein the toggle arms rebound under the resilient bias toward the normal upper position, and the rebound motion causes the staple legs to fold.

21. The stapler of claim 17, wherein the positions and motions of the toggle arms correspond to a sequence of clinching actions, and the sequence is controlled by elements, including the staple legs, substantially entirely within the clinch assembly and the staple leg is the only operative link to the stapler body to control motions of the toggle arms.

22. A clinch assembly for a desktop stapler having a base for forming legs of a staple behind a stack of sheet media, comprising:

a frame fitted to a top of the base, wherein the frame includes at least two walls forming a slot therebetween;

a toggle arm pivotally attached within the slot and guided by the slot, and wherein the toggle arm is resiliently biased toward a normal upper position substantially flush with a top edge of the slot;

wherein during a staple leg clinching action, the toggle arm is deflected downward into the slot against the resilient bias; and wherein during a staple leg folding action, the toggle rebounds under the resilient bias.

* * * * *